US005201511A

United States Patent [19]

Kim

[11] Patent Number: 5,201,511

[45] Date of Patent: Apr. 13, 1993

[54] DEVICE FOR RESTRAINING ABRUPT POURING OF PAPERS FOR PAPER SUPPLY CASSETTE

[75] Inventor: Dong S. Kim, Seoul, Rep. of Korea

[73] Assignee: Goldstar, Co., Ltd., Seoul, Rep. of Korea

[21] Appl. No.: 738,173

[22] Filed: Jul. 30, 1991

[30] Foreign Application Priority Data

Jul. 31, 1990 [KR] Rep. of Korea ..... 11307/1990

[51] Int. Cl.[5] ..... B65H 1/04

[52] U.S. Cl. ..... 271/127; 271/164

[58] Field of Search ..... 271/127, 162, 164, 22

[56] References Cited

U.S. PATENT DOCUMENTS 3,944,355 3/1976 Matkan .

4,023,792 5/1977 Punnett ..... 271/127 X 4,478,401 10/1984 Shibuya ..... 271/164 X 4,577,850 3/1986 Takeyama ..... 271/127 X 4,750,729 6/1988 Kanoto ..... 271/162

*Primary Examiner*—Richard A. Schacher

*Attorney, Agent, or Firm*—David E. Lovejoy

[57] ABSTRACT

A device for restraining abrupt pouring of the papers for paper supply cassette. The device comprises a pair of turning members each disposed about each front side portion of a box-shaped housing of said paper supply cassette, and tension coil spring. The turning member comprises a supporter having a horizonal part and a vertical part, and an actuating lever having a horizontally extending connecting part and a downwardly extending actuating part integrally formed with said connecting part. The tension coil spring is disposed between the side wall of the housing and the connecting part in order to bias said turning member counterclockwise. The device according to this invention provides advantage in that it supports the front ends of the papers in the cassette, thereby preventing the abrupt pouring of the papers efficiently.

3 Claims, 2 Drawing Sheets

DEVICE FOR RESTRAINING ABRUPT POURING OF PAPERS FOR PAPER SUPPLY CASSETTE

BACKGROUND OF THE INVENTION

The present invention relates to a detachable paper supply cassette for printers, and more particularly to a device for restraining abrupt pouring of papers in order to prevent abrupt pouring thereof and also elastically turns clockwise in order to allow the draw of the paper out of the paper supply cassette.

Conventionally, known detachable paper supply cassette for a printer has a main body comprising the box-shaped housing having front and rear walls, side walls and a bottom plate, and an openable cover for covering the housing except for a front upper portion thereof, thereby providing a paper supply opening. This type of paper supply cassette is generally provided with a paper supporting plate elastically supported by means of a plate spring which is fixedly mounted at an end thereof to the bottom plate of the housing and at the other end thereof to an under surface of the paper supporting plate, so that the paper supporting plate is supported as lifted up at the front end thereof.

In operation, this paper supply cassette with papers on the paper supporting plate thereof is loaded in the supply part of the printer and the paper supply operation is accomplished by supplying the papers one by one to the printing part of the printer by means of revolution of the supply roller of the printer.

However, the known paper supply cassette has a disadvantage in that it is not provided with a device for restraining abrupt pouring of the papers so that the papers may be abruptly poured from the paper supply opening of the cassette due to listing thereof through user's carelessness during loading the cassette to the printer.

SUMMARY OF THE INVENTION

It is, therefore, an object of the present invention to provide a device for restraining abrupt pouring of the papers for paper supply cassette in which the above disadvantage can be overcome and which supports front ends of papers in order to restrain abrupt pouring thereof and also elastically turns clockwise in order to allow the papers to be drawn one by one out of the paper supply cassette.

The above-mentioned object of the present invention can be accomplished by providing a device for restraining abrupt pouring of the papers for paper supply cassette comprising: a pair of turning members each disposed about each front side portion of a box-shaped housing of said paper supply cassette comprising; a supporter having a horizontal part and a vertical part vertically extending from an end of said horizontal part, said supporter capable of contacting with ends of papers in order to restrain pouring of said papers in vertical position of said turning member but making said papers be free from contact therewith in order to allow said papers to be drawn one by one in horizontal position of said turning member; and an actuating lever having a horizontally extending connecting part integrally formed with said vertical part of the supporter and hinged at a hinge connection to a side wall of said housing, and a downwardly extending actuating part integrally formed with said connecting part and having an actuating surface; a pair of tension coil spring disposed between said side wall of the housing and said connecting part at a portion before said hinge connection in order to bias said turning member counterclockwise; said turning member turning clockwise by means of pressing means for providing a pressing force acting on said actuating surface of said actuating lever but turn counterclockwise by virtue of the restoring force of said tension coil spring if said pressing force having acted on said actuating surface is removed.

BRIEF DESCRIPTION OF THE DRAWINGS

The above and other objects, features and other advantages of the present invention will be more clearly understood from the following detailed description taken in conjunction with the accompanying drawings, in which:

FIG. 3A shows an unloading position of the device; and FIG. 3B shows a loading position of the device.

DETAILED DESCRIPTION OF THE PREFERRED EMBODIMENTS

Figure 1:
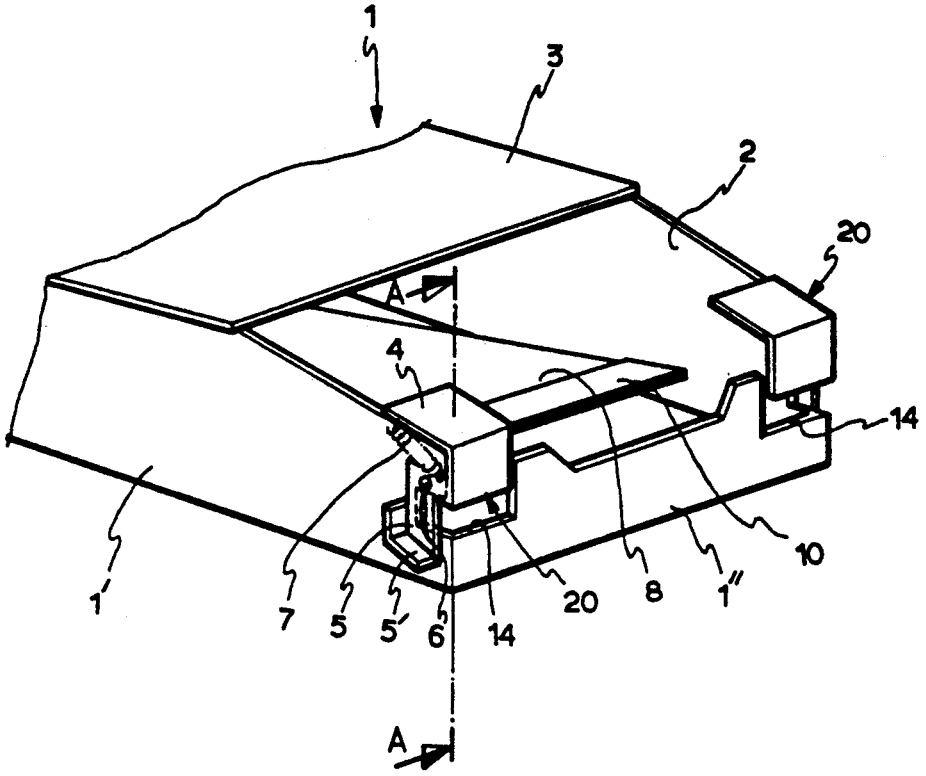
FIG. 1 is a perspective view of a paper supply cassette provided with a device for restraining abrupt pouring of the papers in accordance with the present invention.
Figure 2:
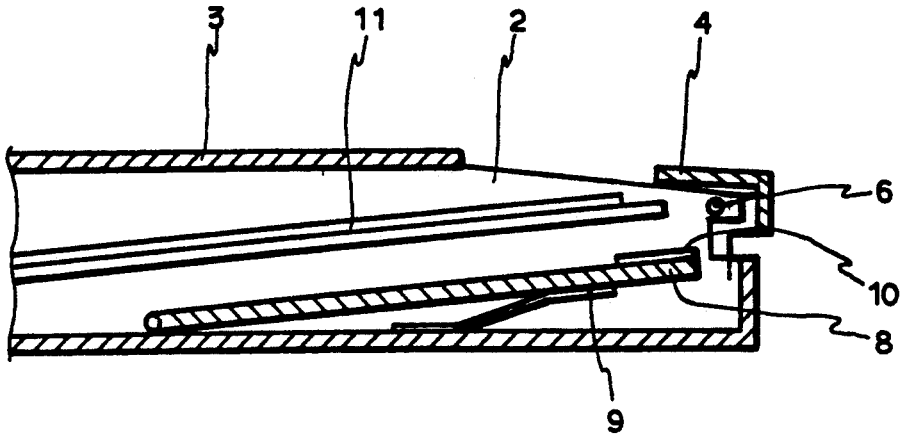
FIG. 2 is a sectional view taken along the line A—A' of FIG. 1.

Referring now to FIGS. 1 and 2 which are a perspective view of a paper supply cassette provided with a device for restraining abrupt pouring of the papers in accordance with the present invention, and a sectional view taken along the line A—A' of FIG. 1, the paper supply cassette (hereinafter, referred to simply as "the cassette") comprises a box-shaped housing 1 having side walls 1' and a front wall 1", an openable cover 3 for covering said housing except for a paper supply opening 2, a paper supporting plate 8 elastically supported by means of a plate spring 9 which is fixedly mounted at an end thereof to a bottom plate of said housing 1 and at the other end thereof to an under surface of said paper supporting plate 8, so that this paper supporting plate 8 is supported as lifted up at the front end thereof. Also, the cassette is provided with the device for restraining abrupt pouring of the papers 11 rotatably mounted to front side portions of said box-shaped housing 1.

The device for restraining abrupt pouring of the papers (hereinafter referred to simply as "the device") comprises a pair of turning members 20 each hinged to each front side portion of the box-shaped housing 1 and each tension coil spring 7 disposed between each side wall of the housing 1 and each said turning member 20. The turning member 20 comprises a supporter 4 and an actuating lever 5, integrally formed with each other. The supporter 4 comprises a horizontal part and a vertical part vertically extending from an end of said horizontal part, and is able to contact with ends of papers in order to restrain pouring of said papers 11 in vertical position of the turning member 20 but makes said papers 11 be free from contact therewith in order to allow said papers 11 to be drawn one by one in horizontal position of said turning member 20. Also, the actuating lever 5 comprises a horizontally extending connecting part integrally formed with the vertical part of the supporter 4 and hinged at a hinge connection 6 to the side wall 1' of the housing 1, and a downwardly extending actuating part integrally formed with said connecting part and having an actuating surface 5'. The tension coil spring 7 is disposed between the side wall 1' of the housing 1 and the horizontally extending connecting part of the actuating lever 5 at a portion before the hinged connection 6, thereby biasing the turning member 20 counterclockwise.

On the other hand, a cutoff 14 is provided at each front side portion of the housing 1 in order to allow the turning member 20 to turn clockwise (see FIG. 1).

Thus, the turning member 20 turns clockwise by means of a pressing force acting on the actuating surface 5' of the actuating lever 5, and alternately turns counterclockwise by virtue of the restoring force of the tension coil spring 7 if said pressing force having acted on said actuating surface 5' in removed.

Figure 3A:
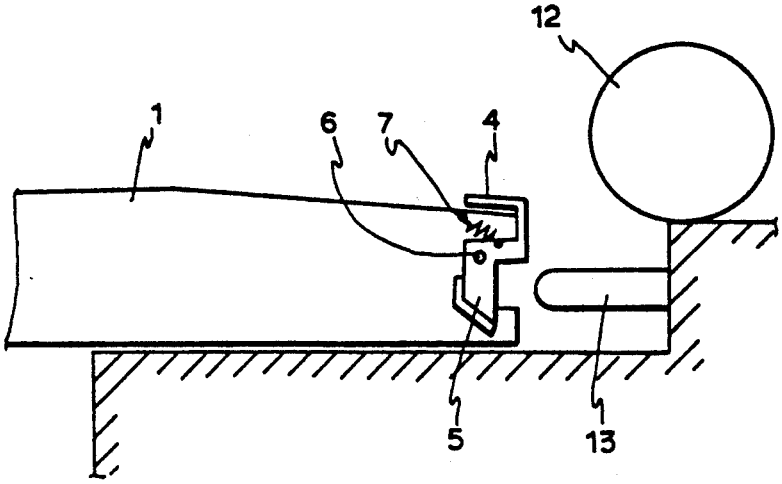
FIGS. 3A and 3B are sectional views showing positions of the device for restraining abrupt pouring of the papers of FIG. 1, respectively.
Figure 3B:
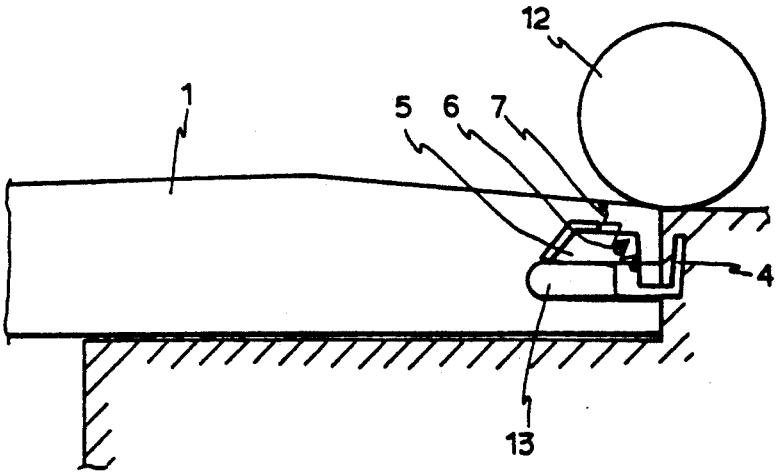

In this embodiment, there is provided an actuating rod 13 for providing the pressing force acting on the autuating surface 5' of the actuating lever 5. As shown in FIGS. 3 and 4, this actuating rod 13 horizontally extends at a position corresponding to said actuating surface from a vertical surface under a paper supply roller 12 of the paper supply portion of the printer.

In the drawings, the reference numeral 10 denotes a frictional pad provided on the front upper surface of the paper supporting plate 8.

The operational effect of the device in accordance with this invention will be described as follws.

As described above, the paper supporting plate 8 is lifted up at the front end thereof by virtue of the plate spring 9 so that the papers 11 on said paper supporting plate 8 is supported at respective front ends thereof by the inner surface of the supporter 4 of the turning member 20, thereby restraining the abrupt pouring of the papers 11 from the housing 1 during movement of the cassette. As the cassette of the above state is loaded at the paper supply portion of the printer as represented in FIGS. 3 and 4, the actuating surface 5' of the actuating lever 5 contacts with the actuating rod 13 and then is pushed backward against the restoring force of the tension coil spring 7 as the cassette advances toward the loading position thereof, thereby causing the turning member 20 to continuously turn clockwise around the hinge connection 6 till accomplishing 90° clockwise turning. At this 90° clockwise turning state, top of the papers 11 contacts with the under portion of the paper supply roller 12 as a result of the clockwise turning of the supporter 4, so that the top paper 11 of the papers can be drawn by the rolling operation of the paper supply roller 12. Alternately, if the cassette is withdrawn from the paper supply portion of the printer as requested, the pressing force having acted on the actuating surface 5' is gradually removed as the cassette is withdrawn. Thus, the turning member 20 turns counterclockwise by virtue of the restoring force of the tension coil spring 7.

In the above description, the pressing member for providing the pressing force for turning the turning member 20 comprises the actuating rod 13 mounted to the paper supply portion of the printer. However, it should be noted that the pressing member may comprise another type of member beside the above actuating rod 13 within the scope of the present invention. For example, the actuating rod 13 may be rotatably mounted to the actuating surface 5' of the actuating lever 5 instead of being fixedly mounted to the paper supply portion of the printer.

As described above, it is known that the device in accordance with this invention provides advantage in that it supports the front ends of the papers in the cassette, thereby preventing the abrupt pouring of the papers efficiently.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A device for restraining abrupt pouring of papers from a box-shaped housing of a paper supply cassette comprising:

a pair of turning members disposed at the sides of said box-shaped housing where each turning member includes, a supporter having a horizontal part and a vertical part vertically extending from an end of said horizontal part, said supporter moveable to a vertical position for contacting with ends of papers in order to restrain pouring of said papers and movable to a horizontal position free from contact with said papers in order to allow said papers to be drawn one by one from said housing, an actuating lever having a horizontally extending connecting part integrally formed with said vertical part of the supporter and hinged at a hinge connection to a side wall of said housing, and a downwardly extending actuating part integrally formed with said connecting part and having an actuating surface, a tension coil spring disposed between said side wall of the housing and said connecting part in order to bias said turning member counterclockwise, said turning member being able to turn clockwise by means of pressing means for providing a pressing force acting on said actuating surface of said actuating lever and to turn counterclockwise by virtue of the restoring force of said tension coil spring if said pressing force having acted on said actuating surface is removed.

2. A device for restraining abrupt pouring of papers as claimed in claim 1, wherein said pressing means comprises an actuating rod horizontally extending from a paper supply portion of a printer that receives the paper supply cassette at a position corresponding to said actuating surface.

3. A paper supply cassette for providing papers to a printer where the cassette includes a box-shaped housing slidably into the printer to engage a pressing member of said printer, said cassette including a device for restraining the papers in the cassette comprising:

a pair of turning members disposed at the sides of said box-shaped housing where each turning member includes, a supporter moveable in a first direction to restrain said papers when the cassette is not engaged in the printer and movable in a second direction to free said papers when the cassette is engaged in the printer, an actuating member connected to the supporter and hinged to said housing, said actuating member having an actuating surface engaged by said printer member for turning said supporter in said second direction so as to free said papers, a spring disposed between said housing and said actuating member to bias said supporter in said first direction when the actuating surface is not engaged by said pressing member so as to restrain said papers.

* * * * *